US007040623B2

(12) United States Patent
Poffenberger

(10) Patent No.: US 7,040,623 B2
(45) Date of Patent: May 9, 2006

(54) GAME SCORING KIT

(76) Inventor: Douglas Poffenberger, 4471 Estate Ct., Mason, OH (US) 45040

( * ) Notice: Subject to any disclaimer, the term of this patent is extended or adjusted under 35 U.S.C. 154(b) by 0 days.

(21) Appl. No.: 10/944,976

(22) Filed: Sep. 20, 2004

(65) Prior Publication Data

US 2006/0061034 A1 Mar. 23, 2006

(51) Int. Cl.
*A63F 3/00* (2006.01)

(52) U.S. Cl. ..... 273/236; 273/148 R

(58) Field of Classification Search ..... 273/236, 273/148 R; 434/128
See application file for complete search history.

(56) References Cited

U.S. PATENT DOCUMENTS 4,158,342 A * 6/1979 Scruggs ..... 116/225
4,164,910 A 8/1979 Feiler
5,025,748 A 6/1991 Pettis
5,489,122 A * 2/1996 Pittner ..... 283/49

* cited by examiner

*Primary Examiner*—Vishu K. Mendiratta
(74) *Attorney, Agent, or Firm*—Wood, Herron & Evans, LLP

(57) ABSTRACT

A scoring kit of materials and method of using the materials of the kit to facilitate scoring of a game such as cornhole. The kit comprises a scoring strip having score indicia printed on one side and adhesive applied to the other side, a release overlay strip covering the adhesive of the scoring strip, a Velcro score marker holding strip having Velcro material on one side and adhesive on the other side, a release overlay strip covering the adhesive of the Velcro score marker holding strip, and a plurality of differing color Velcro score markers. Additionally, the kit may include a Velcro storage holder strip having Velcro material on one side and adhesive on the other side with a release overlay strip covering the adhesive on the Velcro storage holder strip.

7 Claims, 1 Drawing Sheet

GAME SCORING KIT

FIELD OF THE INVENTION

This invention relates to a kit of materials used to create a gameboard score keeping device. More particularly, this invention relates to an easily assembled kit of materials utilized to create a score keeping device for use on a gameboard as, for example, a gameboard of a game called "cornhole".

BACKGROUND OF THE INVENTION

For the benefit of those who are not familiar with this game, it comprises a gently sloping nearly horizontal board approximately two feet wide and four feet deep having a hole near the rear of the board. This gameboard has a playing surface which is supported approximately four inches above ground level at the front and twelve inches above the ground at the rear. The game utilizes two such boards spaced approximately 30 feet apart and multiple bean bags as, for example, four bean bags per participant. The bean bags are of differing color for each participant. The game is played much like horseshoes in that the participants stand beside one of the gameboards and pitch the bean bags toward the second or other one of the boards, attempting to place the bag either on the playing surface of the second board for a score of one point or in the hole for a score of three points. After both participants have alternately tossed their bags toward the second board, the difference in score between the two participants is added to the score of that participant who scored the highest points in that series of tosses. As for example, if the first participant scores three points with his four bags, and the other or second participant scores five points, then the second participant adds two points to his score, whereupon the two participants move to the second board and pitch their bags back toward the first board. This procedure is followed until one of the participants reaches game score as, for example, a score of 21 points.

The score keeping device of this invention, and the kit from which it is assembled, is intended to facilitate the keeping of score during the course of a game, such as cornhole. Necessarily, this score keeping can be confusing and result in errors in the absence of some form of scoreboard or score keeping device. Additionally, this score keeping device, when utilized in the course of the game, enables spectators to readily determine the score throughout the course of the game.

It has therefore been an objective of this invention to provide an easily visible, new and improved score keeping device to be utilized in connection with gameboards, such as cornhole gameboards, to facilitate the keeping of score during the course of the game.

Another objective of this invention has been to provide a kit of materials which may be easily added to a gameboard as, for example, a cornhole gameboard, to facilitate the keeping of score of the game during the course of the game.

Still another objective of this invention has been to provide an inexpensive kit of materials which may be easily and conveniently added to one side of a gameboard so as to facilitate the keeping of score of the game during the course of the game.

BRIEF DESCRIPTION OF THE INVENTION

To accomplish these objectives, the invention of this application comprises a kit of materials for assembly and attachment to a gameboard, which kit comprises a scoring strip having indicia on one side and an adhesive on the other, a release overlay strip covering the adhesive on the other side of the scoring strip, a Velcro score marker holding strip having Velcro hook or loop on one side and adhesive on the other side of the Velcro score marker holding strip, and a plurality of differing color Velcro score markers having hook or loop material on one side. As used throughout this application, the trademark term "Velcro" refers to a strip of material having either a hook or loop material on the surface thereof which can be fastened to another strip of material having the other of a hook or loop material on the surface thereof. In the use of this scoring strip, the release overlay strip covering the adhesive on the side of the scoring strip is removed and the scoring strip attached via the adhesive to a side edge of the playing board. The release overlay strip covering the adhesive on the adhered side of the score marker holding strip is removed and the score marking strip adhered to the board either immediately below the bottom edge or immediately above the top edge of the scoring strip, such that the Velcro score marker holding strip extends beneath or atop and parallel to the indicia of the scoring strip. Two or more differing color Velcro score markers are then selected and attached via their Velcroed surface to the Velcro surface of the score marker holding strip.

In the course of two or more players playing the game, their respective differing color Velcroed scored markers are then moved along the scoring strip via attachment to the Velcro score marker holding strip so as to indicate the score of the game of each player side as the game progresses.

In the preferred embodiment of the invention, there is also a Velcro storage holder strip having hook or loop material on one side and adhesive on the other side, as well as a release overlay strip covering the adhesive on the other side of the Velcro storage holder strip. In the course of the use of the kit employing this Velcro storage holder strip, that Velcro storage holder strip is applied to a surface and, preferably, another side or the bottom surface of the gameboard so as to hold the plurality of differing color Velcro score markers in place until selected for use in the course of the game.

The primary advantage of the scoring kit of this invention is that it enables a scoring device to be applied to the side edge of a gameboard in an easy and inexpensive manner so as to create an easily usable scoring device on that gameboard for keeping score of the game. This device is not only inexpensive, but it is easily applied to the board and is easily used to maintain score of the game as the game progresses and the score markers are moved throughout the course of the game. That and other advantages of this game will be more readily apparent from the following description of the drawings.

BRIEF DESCRIPTION OF THE DRAWINGS

With reference to FIG. 1, there is illustrated a conventional cornhole gameboard 10 having the scoring device 12 of this invention applied thereto. This scoring device 12 is made up from a plurality of kit components 14 illustrated in FIG. 2.

As illustrated in FIG. 1, the cornhole gameboard comprises a top playing surface 16 on a top board 17, as well as four side walls or side boards 18, 20, 22 and 24. The rectangular playing surface 16 of the gameboard is generally two feet in width W and four feet in depth D. Near the rear edge of the gameboard, there is a hole 26 approximately six inches in diameter having a center 30 located at approximately the midpoint of the width of the board and a distance L approximately one foot from the rear edge 16*a* of the board. This playing surface is supported approximately four inches above ground level at the front edge 16*b* of the board and approximately 12 inches, or one foot, off the ground at the rear edge 16*a* such that the playing surface slopes slightly from front to rear.

Figure 1:
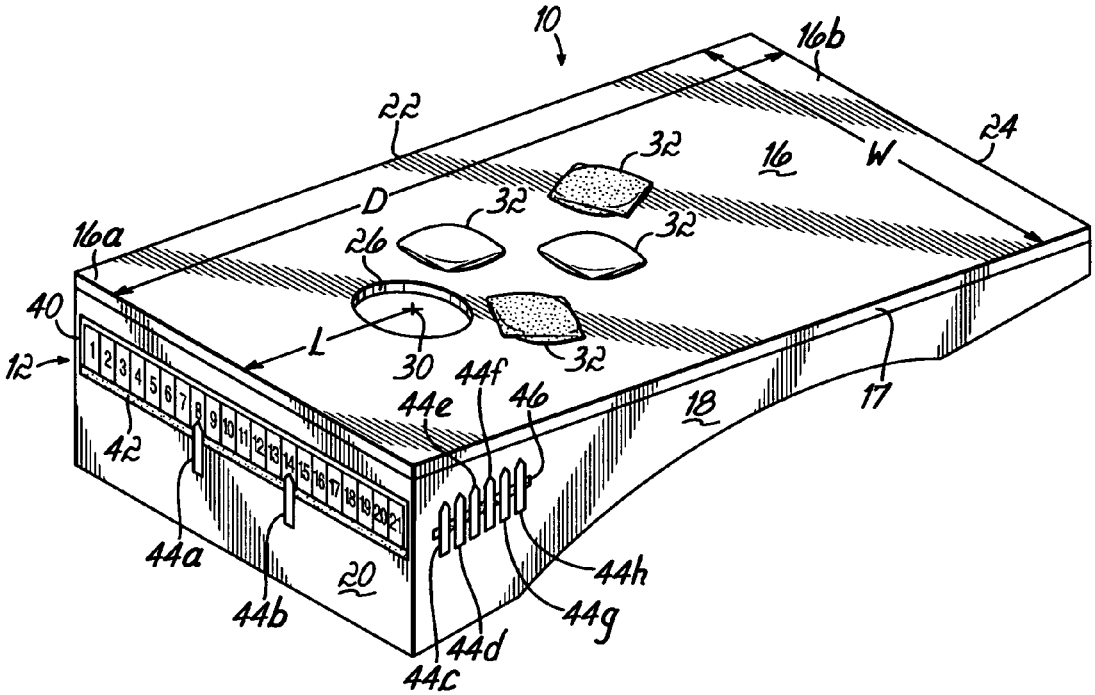
FIG. 1 is a perspective view of a cornhole gameboard having the scoring device of this invention applied thereto.

In the case of the illustrated cornhole gameboard, the playing surface or board having the playing surface thereon is supported above the ground in the case of the illustrated board by the side walls 18, 22 and front and rear walls 24 and 20, respectively. Alternatively, the gameboard could have rectangular side walls or side boards 18, 20, 22, 24 attached thereto and front and rear legs of differing lengths to support the board above the ground at these levels. Additionally, the gameboard may be of differing dimensions from those set forth hereinabove, but the dimensions described hereinabove are increasingly becoming standard for the cornhole game as it becomes more popular and used in competitive events.

The cornhole game is played with two gameboards 10 and a plurality of beanbags 32. If there are two participants in the game, then each participant has a plurality of beanbags of one color assigned to that participant, and the other participant has the same number of beanbags of a differing color assigned to that second participant. The two gameboards 10 are placed approximately 30 feet apart, although this distance is arbitrary, but is increasingly becoming standardized. The game is played by the participants standing beside one of the gameboards and pitching the beanbags toward the second or other one of the boards, attempting to place each bag either on the playing surface of the second board for a score of one point, or in the hole for a score of three points. After both participants have alternately tossed all of their bags toward the second gameboard 10, the difference in score between the two participants is added to the score of that participant who scored the highest points in that series of tosses as, for example, if the first participant scores three points with four bags 32 and the other or second participant scores five points, then the second participant adds two points to his score, whereupon the two participants move to the second board and pitch the bags back toward the first. Alternatively, if there are four participants in the game, then the participants maintain their positions adjacent one or the other of the two gameboards and pitch their beanbags back and forth with two of the participants on one team adjacent each gameboard using the beanbags of one color and the two other participants utilizing the beanbags of a second color.

In order to keep score of the game as the game progresses, the invention of this application utilizes the scoring device 12. This scoring device comprises a scoring strip 40 adhered to one side wall of the gameboard 10, in the case of the illustrated gameboard, the rear side wall 20. This scoring strip has scoring indicia printed on the outward facing side of the strip. Beneath the scoring strip, there is a strip of Velcro material located immediately adjacent or contacting the bottom edge of the scoring strip and adhered to the side wall 12. This Velcro strip has either conventional Velcro hook or loop material on the outwardly facing side of the strip. As may be seen in FIG. 1, the Velcro strip extends for the full length of the scoring strip.

In order to keep score of the game played on the gameboard 10, there are two differing color score markers or arrows 44*a* and 44*b* attached by a Velcro surface 45 on the markers to the Velcro strip 42. The color of the markers 44*a* and 44*b* generally are selected so as to match the color of the beanbags 32 utilized by the differing teams of participants of the game.

Although not necessary to the practice of the score keeping function, or the practice of this invention, there is preferably a Velcro marker storage holder strip 46 adhered to a second or differing side wall from the side wall 20 to which the scoring strip is adhered. This Velcro marker storage holder strip has, on the outward side to which additional differing color Velcro markers are attached by the Velcro hook or loop, Velcro of those markers. Of course, if the markers have Velcro hook material on the surface, then the Velcro marker storage holder strip has loop Velcro material on its surface as would the score marker holding strip 42. Of course, the hook and loop relationship between the markers and the storage strip, as well as the scoring holding strip, could be reversed with the hook material on the holding and storage strips 42 and 46 and the loop Velcro material on the surface of the marker.

Figure 2:
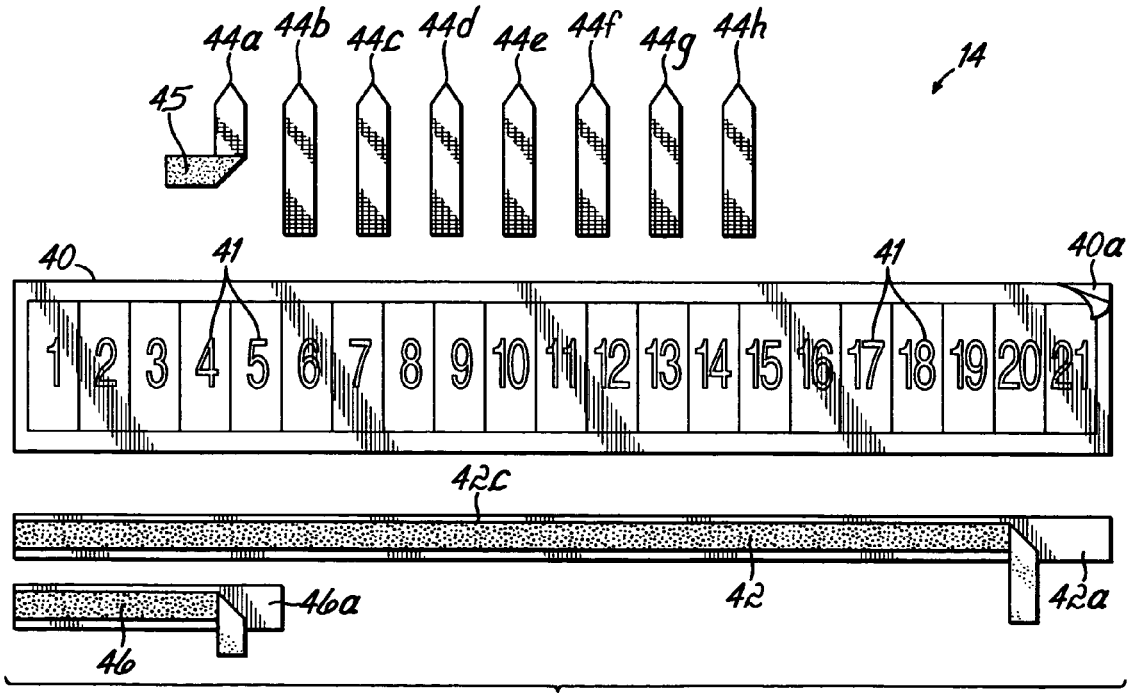
FIG. 2 is a front elevational view of the kit components of the scoring device of this invention.

The scoring device 12 of this invention is preferably sold as a kit of components to be added to a cornhole or similar gameboards 10 so as to facilitate the keeping of score during the course of the game played on the gameboard. The kit components are illustrated in FIG. 2. With reference now to FIG. 2, the scoring kit components comprise the scoring strip 40 having score indicia 41 printed on one side and conventional pressure sensitive adhesive applied to the other side, as well as a paper release overlay strip 40*a* covering the adhesive on the other side of the scoring strip. Additionally, the scoring kit comprises the Velcro score marker holding strip 42 having either hook or loop Velcro material on one side and adhesive on the other side with a plastic film release overlay strip 42*a* covering the pressure sensitive adhesive on the other side of the score marker holding strip 42. The kit also comprises a plurality of differing color Velcro score markers 44*a*–44*h* having either hook or loop Velcro material on one side with the markers being rigid such that they are easily attached to and remain upright when secured to the marker holding strip 42. There are a number of such Velcro score markers 44*a*–44*h* of differing color such that markers may be selected which match the color of beanbags to be used during the course of the cornhole game played on the gameboard to which the kit components are to be applied. In the illustrated embodiment, there are eight such markers, but there could be as few as two.

The kit further comprises the Velcro storage holder strip 46 which has Velcro hook or loop material on one side and pressure sensitive adhesive on the other side. A plastic film release strip 46*a* covers the adhesive on the back side of the Velcro storage holder strip.

In the use of the scoring kit 14, the release backing strip 40*a* is first removed from the back side of th scoring strip 40 and the scoring strip applied to one side, as for example, the rear side 20 of the gameboard 10 with the indicia facing outwardly from the side 20 such that the scoring strip is adhered to that side 20. Next, the release backing strip 42*a* is removed from the Velcro score strip 42 and that strip 42 placed against the side to which the scoring strip had been applied with the Velcro surface of the scoring strip facing outwardly and the pressure sensitive adhesive on the back side of the score marker holding strip placed against the surface of th side 20 to which the scoring strip is adhered. This Velcro score holding strip 42 is positioned immediately adjacent the bottom or top edge of the scoring strip, preferably the bottom edge, with the top edge 42*c* of the Velcro score marker holding strip 42 contacting the bottom edge of the scoring strip.

Lastly, and in the preferred embodiment of the invention, the backing strip 46*a* is removed from the Velcro storage holder strip 46 and that Velcro storage strip pressed against another side wall as, for example, the wall 18 of the gameboard 10, such that the Velcro storage holder strip is adhered to that side wall 18 with the Velcro hook or loop surface facing outwardly. The differing color Velcro markers 44*a*–44*h* are then placed in contact with the Velcro storage holder strip with the Velcro storage holder strip 46. The gameboard is then ready for play with any two of the Velcro markers 44*a*–44*h* available for use as markers for scoring during the course of the game play on the gameboard 10. The color of the two markers selected is generally the same as, or closely matching, the colors of the beanbags 32 used in the course of play of the game.

Of course, while I have described the gameboard to which this invention is applicable as a cornhole gameboard, it could, of course, be used with other gameboards of similar games. And, of course, the gameboard dimensions and other specific details of the scoring kit of this invention may be varied without departing from the spirt of my invention. Therefore, I do not intend to be limited except by the scope of the following appended claims.

I claim:

1. A scoring kit of materials for assembly and attachment to a gameboard to enable the keeping of score of a game employing the board, which kit comprises:

a scoring strip having score indicia printed on one side and adhesive applied to the other side;

a release overlay strip covering the adhesive on the other side of the scoring strip;

a score marker holding strip having a length dimension of at least the same length as the length of the scoring indicia on the scoring strip, the score marker holding strip having one of hook and loop material on one side and adhesive on the other side;

a release overlay strip covering the adhesive on the other side of the score marker holding strip; and a plurality of differing color score markers having one of hook and loop material on one side.

2. The scoring kit of claim 1 wherein the release overlay strip covering the adhesive on the other side of the scoring strip is a release paper strip.

3. The scoring kit of claim 1 wherein the release overlay strip covering the adhesive on the score marker holding strip is a plastic release film material.

4. The cornhole scoring kit of claim 1 which further comprises a storage holder strip having one of hook and loop material on one side and adhesive on the other side; and a release overlay strip covering the adhesive on the other side of the storage holder strip.

5. The scoring kit of claim 1 which further comprises a storage holder strip having one of hook and loop material on one side and adhesive on the other side; and a release overlay strip covering the adhesive on the other side of the storage holder strip.

6. The scoring kit of claim 5 wherein the release overlay strip covering the adhesive on the other side of the storage holder strip is a plastic release film material.

7. A cornhole scoring kit of materials for assembly and attachment to a cornhole gameboard to enable the keeping of score of a cornhole game, which kit comprises:

a scoring strip having cornhole score indicia printed on one side and adhesive applied to the other side;

a release overlay strip covering the adhesive on the other side of the scoring strip;

a score marker holding strip having a length dimension of at least the same length as the length of the scoring indicia on the scoring strip, the score marker holding strip having one of hook and loop material on one side and adhesive on the other side;

a release overlay strip covering the adhesive on the other side of the score marker holding strip; and a plurality of differing color score markers having one of hook and loop material on one side.

* * * * *